United States Patent [19]

Ito et al.

[11] 4,381,941

[45] May 3, 1983

[54] METHOD FOR IMPROVING SURFACE DEFECT OF SPECIFIC STEEL RESISTANT TO CONCENTRATED NITRIC ACID

[75] Inventors: Naoya Ito, Koganei; Takeshi Yoshida; Masahiro Aoki, both of Joetsu; Masao Okubo; Masayoshi Miki, both of Niihama, all of Japan

[73] Assignee: Sumitomo Chemical Company, Limited, Osaka, Japan; Nippon Stainless Steel Co., Tokyo, Japan

[21] Appl. No.: 246,859

[22] Filed: Mar. 23, 1981

[30] Foreign Application Priority Data

Apr. 2, 1980 [JP] Japan ..... 55-43792

[51] Int. Cl.[3] ..... C22C 33/00

[52] U.S. Cl. ..... 75/130.5; 75/128 T; 75/129

[58] Field of Search ..... 75/130.5, 128 T, 129

[56] References Cited

U.S. PATENT DOCUMENTS 3,607,461 9/1971 Stanley ..... 75/130.5

3,836,406 9/1974 Yoda ..... 75/130.5

*Primary Examiner*—P. D. Rosenberg

*Attorney, Agent, or Firm*—Stevens, Davis, Miller & Mosher

[57] ABSTRACT

A method for improving surface defect of specific steel resistant to concentrated nitric acid, wherein the specific steel in a molten state, either a stainless steel comprising $C \leqq 0.1$ wt %, $2.5 \leqq Si \leqq 5$ wt %, $Mn \leqq 2$ wt %, $15 \leqq Cr \leqq 20$ wt %, $10 \leqq Ni \leqq 22$ wt %, $C \times 10 \leqq$ at least one of Nb, Ta and $Zr \leqq 2.5$ wt %, the balance being iron and inevitable impurities, or a high-silicon-nickel-chromium steel comprising $C \leqq 0.03$ wt %, $5 \leqq Si \leqq 7$ wt %, $Mn \leqq 10$ wt %, $7 \leqq Cr \leqq 16$ wt %, $10 \leqq Ni \leqq 19$ wt %, $C \times 4 \leqq$ at least one of Nb, Ta and $Zr \leqq 2$ wt %, the balance being iron and inevitable impurities, is admixed with titanium ($0.05 \leqq Ti \leqq 0.2$ wt %) when producing said steel.

4 Claims, 6 Drawing Figures

METHOD FOR IMPROVING SURFACE DEFECT OF SPECIFIC STEEL RESISTANT TO CONCENTRATED NITRIC ACID

This invention relates to a method for improving surface defect which appears on the surface of steel plate, wherein the steel is either a specific stainless steel or a high-silicon-nickel-chromium steel, which is a material suitable for apparatus treating high concentration nitric acid.

As materials for construction of apparatus for working with nitric acid having a concentration above that of the azeotropic composition, a specific stainless steel (as disclosed in Japanese patent publication (unexamined) No. 72813/1975) and a high-silicon-nickel-chromium steel (as disclosed in Japanese patent publication (unexamined) No. 91960/1980) have been proposed. The specific stainless steel comprises carbon in an amount of not more than 0.1% ($C \leqq 0.1\%$), silicon in an amount from not less than 2.5% to not more than 5.0% ($2.5 \leqq Si \leqq 5.0\%$), manganese in an amount of not more than 2% ($Mn \leqq 2\%$), chromium in an amount from not less than 15% to not more than 20%, nickel in an amount from not less than 10% to not more than 22%, at least one of niobium, tantalum and zirconium in an amount from not less than 10 times the carbon content to not more than 2.5%, with the balance being iron and inevitable impurities, where % is by weight. The high-silicon-nickel-chromium steel comprises carbon in an amount of not more than 0.03%, silicon in an amount from more than 5% to not more than 7%, manganese in an amount of not more than 10%, chromium in an amount from not less than 7% to not more than 16%, nickel in an amount from not less than 10% to less than 19%, at least one of niobium, tantalum and zirconium in an amount from 4 times the carbon content to not more than 2%, and the balance being iron and inevitable impurities, where % is by weight. Niobium, tantalum and zirconium serve as a stabilizer for the carbon which is contained in the specific stainless steel or the high-silicon-nickel-chromium steel. They combine with oxygen and nitrogen to make clusters of oxide and nitride in the step of steel making. These clusters appear on the surface of steel plate to make defects of the so-called snow, type or just under the surface to make blister defects when subjected to hot rolling or cold rolling. These defects cause cracks on steel materials in the bending process and considerably reduce product value.

Table 1 shows specific gravities of oxides and nitrides of niobium, tantalum and zirconium, which form the clusters.

Specific gravities of the clusters are substantially equal to that of the steel, but are remarkably greater than the steel in the example of tantalum as is seen from Table 1. Therefore, the clusters formed in the melted steel cannot be easily separated from the steel by flotation and are retained in the steel and bring about surface defects on steel plate.

The surface defects appearing on conventional steel plate to which the present invention is applied are shown in FIGS. 1 and 2.

An object of the present invention is to provide a method of reducing or improving surface defects in the process of producing steel. Details of the present invention will be described below.

TABLE 1

Specific gravity of the steel and oxide and nitride of niobium, tantalum and titanium

| Element | Oxide | | Nitride | |
|---|---|---|---|---|
| Present steel | | 7.63–7.68 | | |
| Nb | NbO | 7.3 | NbN | 7.3 |
| Ta | $TaO_2$ | 10.4 | TaN | 14.3 |
| Zr | $ZrO_2$ | 5.6 | ZrN | 7.3 |
| Ti | $TiO_2$ | 4.2 | TiN | 5.4 |

Vacuum melting process can control contents of oxygen or nitrogen to low levels to minimize contents of non-metallic inclusion (oxide and nitride), but cannot completely eliminate the defects in the base steel. Besides, it is too expensive to use vacuum melting practically.

The present inventors found that the reason why the surface defects appear is that the specific gravity of clusters comprising oxide and nitride of niobium, tantalum and zirconium is so high that it is difficult to separate these clusters from molten steel by flotation and so have made the following tests in various cases, and have accomplished the present invention.

The present invention provides a process which comprises (a) adding titanium in an amount from not less than 0.05 wt% to not more than 0.2 wt% to molten steel after smelting in an electric furnace is finished and before addition of niobium, tantalum and zirconium, wherein oxygen and nitrogen in the steel combine with titanium to form titanium oxide and nitride, the specific gravities of which are smaller than that of molten steel, (b) separating clusters comprising titanium oxide and nitride from the molten steel by flotation, (c) separating the molten residue, (d) adding at least one member of niobium, tantalum and zirconium, where by the tendency to form heavy clusters comprising oxide or nitride of these three metals is suppressed. Sealing by inert gas such as argon is carried out through the process from the addition of titanium to the casting. According to the present invention, it is possible to improve remarkably the surface appearance of the steel.

Outlines of melting processes according to the present invention and the conventional process carried out so far are given below:

Method of the present invention:

Melting period→Oxidizing period→Reducing period→Aluminum deoxidating→Slag off→Addition of titanium→Slag off→Addition of niobium, tantalum and zirconium→Casting.

Method carried out so far:

Melting period→Oxidizing period→Reducing period→Aluminum deoxidation→Slag off→Addition of niobium, tantalum and zirconium→Casting.

In the melting period under atmospheric conditions, oxygen and nitrogen dissolved in molten steel ordinarily amount to 50 to 100 ppm and 100 to 400 ppm, respectively.

According to the present invention, a stoichiometric amount of titanium is sufficient to catch oxygen or nitrogen.

Addition of titanium over the stoichiometric amount brings about an adverse effect upon the prevention of cluster formation because of promotion of oxidation or nitridation in the casting operation. The amount of titanium to be added is therefore restricted to from not less than 0.05 wt% to not more than 0.2 wt%.

The present invention will be explained more concretely with examples and drawings; however, these examples are not to be construed to limit the scope of the invention.

FIGS. 1 and 2 are photographs which show the surface defect state observed on steel for comparison, wherein FIG. 1 shows snow defects and FIG. 2 shows a blister defect.

FIGS. 3–6 show various degrees of snow defects observed on the surface of steel plates, 2 mm thick, wherein FIGS. 3, 4, 5 and 6 show test piece No. 3 (snow defect grade Δ), test piece No. 8 (snow defect grade #), test piece No. 16 (snow defect grade o) and test piece No. 20 (snow defect Δ), respectively.

Examples

Figure 1:
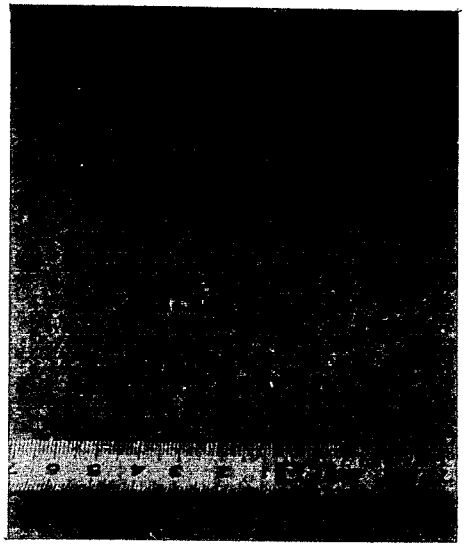
Figure 2:
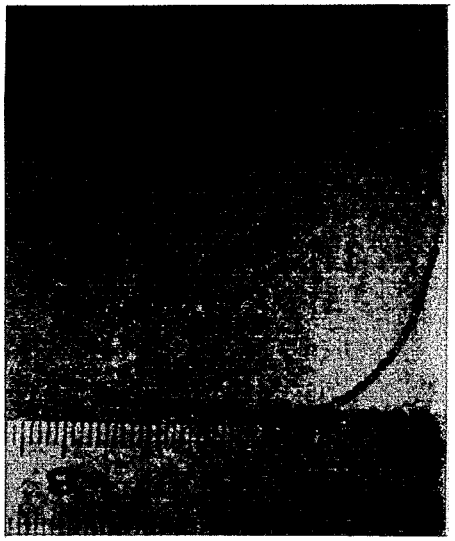

Compositions of test pieces used are shown in Table 2.

TABLE 2

| | Test piece No. | Melting method | Chemical composition of test pieces, wt % | | | | | | | | | | | |
|---|---|---|---|---|---|---|---|---|---|---|---|---|---|---|
| | | | C | Si | Mn | Cr | Ni | N | O* | Nb | Ta | Zr | Ti | Others |
| Steel for comparison | 1 | Vacuum high-frequency induction furnace melting | 0.014 | 4.10 | 0.98 | 17.21 | 14.02 | 0.004 | 56 | 0.72 | — | — | — | — |
| | 2 | Vacuum high-frequency induction furnace melting | 0.013 | 4.03 | 1.00 | 17.37 | 13.78 | 0.004 | 59 | — | — | 0.17 | — | — |
| | 3 | Vacuum high-frequency induction furnace melting | 0.015 | 4.19 | 1.01 | 16.83 | 14.02 | 0.004 | 55 | 0.51 | — | 0.16 | — | — |
| | 4 | Vacuum high-frequency induction furnace melting | 0.014 | 3.86 | 0.96 | 17.05 | 13.96 | 0.004 | 50 | — | 0.30 | 0.20 | — | — |
| | 5 | Vacuum high-frequency induction furnace melting | 0.016 | 6.33 | 0.83 | 10.54 | 16.51 | 0.005 | 48 | — | — | 0.61 | — | — |
| | 6 | Vacuum high-frequency induction furnace melting | 0.015 | 5.73 | 0.70 | 11.81 | 17.25 | 0.006 | 61 | 0.48 | — | — | — | — |
| | 7 | Atmospheric high-frequency induction-furnace melting | 0.020 | 4.12 | 1.05 | 16.97 | 14.10 | 0.024 | 48 | 0.70 | — | — | — | — |
| | 8 | Atmospheric high-frequency induction-furnace melting | 0.023 | 4.20 | 1.07 | 17.08 | 13.84 | 0.019 | 57 | 0.50 | — | 0.24 | — | — |
| | 9 | Atmospheric high-frequency induction-furnace melting | 0.018 | 3.69 | 0.95 | 17.43 | 14.00 | 0.038 | 77 | — | — | 0.34 | — | — |
| | 10 | Atmospheric high-frequency induction-furnace melting | 0.030 | 3.91 | 0.96 | 17.22 | 13.87 | 0.019 | 33 | — | — | 0.60 | — | — |
| | 11 | Atmospheric high-frequency induction-furnace melting | 0.028 | 4.01 | 1.00 | 17.34 | 14.08 | 0.022 | 48 | — | 0.34 | 0.32 | — | — |
| | 12 | Atmospheric high-frequency induction-furnace melting | 0.014 | 6.11 | 0.62 | 10.87 | 18.36 | 0.017 | 63 | 0.76 | — | — | — | — |
| | 13 | Atmospheric high-frequency induction-furnace melting | 0.016 | 6.55 | 0.60 | 11.31 | 18.61 | 0.018 | 68 | — | — | 0.56 | — | — |
| | 14 | Atmospheric high-frequency induction-furnance melting | 0.025 | 4.25 | 0.96 | 17.03 | 13.90 | 0.030 | 80 | 0.75 | — | — | 0.09 | |
| ** | 15 | Atmospheric high-frequency induction furnace melting | 0.025 | 3.99 | 0.95 | 17.24 | 13.94 | 0.019 | 93 | — | — | 0.38 | 0.08 | |
| Steel of the Invention | **** 16 | Atmospheric high-frequency induction-furnace melting | 0.017 | 4.11 | 1.02 | 17.00 | 14.04 | 0.020 | 75 | 0.37 | — | 0.45 | 0.15 | Al 0.002 |

TABLE 2-continued

| | Test piece No. | Melting method | Chemical composition of test pieces, wt % C | Si | Mn | Cr | Ni | N | O* | Nb | Ta | Zr | Ti | Others |
|---|---|---|---|---|---|---|---|---|---|---|---|---|---|---|
| | 17 | Atmospheric high-frequency induction-furnace melting | 0.027 | 4.05 | 0.97 | 16.78 | 13.90 | 0.027 | 68 | — | 0.27 | 0.47 | 0.16 | |
| | 18 | Atmospheric high-frequency induction-furnace melting | 0.015 | 5.78 | 0.70 | 11.81 | 17.25 | 0.017 | 67 | — | — | 0.43 | 0.13 | |
| | ***** 19 | Atmospheric high-frequency induction-furnace melting | 0.017 | 6.09 | 0.74 | 11.16 | 16.63 | 0.015 | 72 | 0.69 | — | — | 0.10 | Ca 0.001 |
| *** Steel for comparison | 20 | Atmospheric high-frequency induction-furnace melting | 0.028 | 3.90 | 1.02 | 17.13 | 14.02 | 0.022 | 57 | 0.48 | — | 0.32 | 0.25 | |
| | 21 | Atmospheric high-frequency induction-furnace melting | 0.025 | 4.59 | 0.98 | 17.14 | 13.92 | 0.023 | | 0.33 | — | 0.61 | 0.22 | |

(Remarks)
*O: ppm
**Amount of Ti added: Test pieces Nos. 14, 15 0.10%
Test pieces Nos. 16, 17 0.15%
Test pieces Nos. 18, 19 0.20%
***Amount of Ti added: Test pieces Nos. 20, 21 0.30%
****Amount of Al added: 0.05%
*****Amount of Ca added: 0.1%

Figure 3:
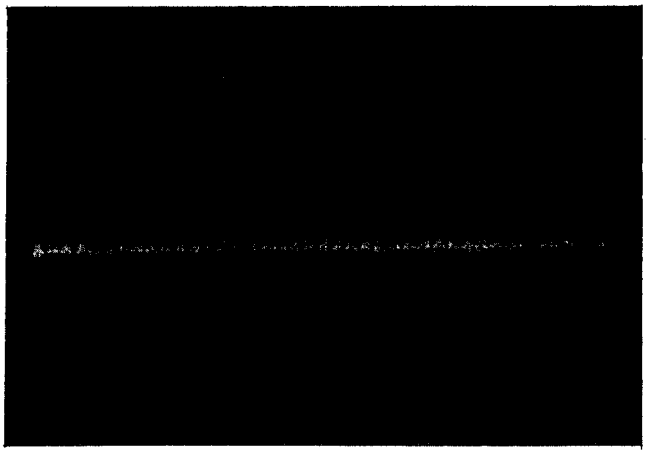
Figure 4:
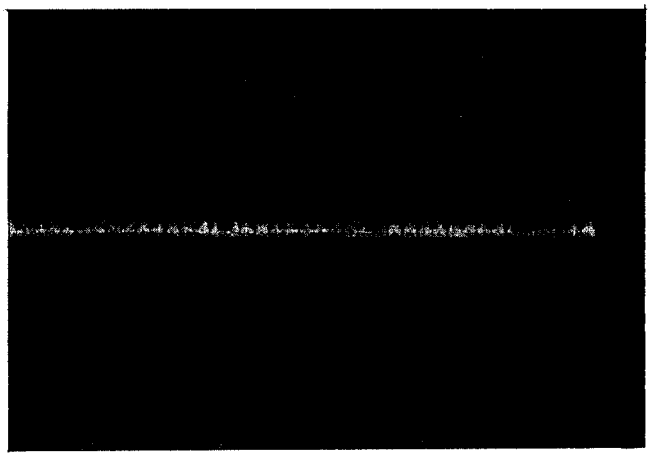
Figure 5:
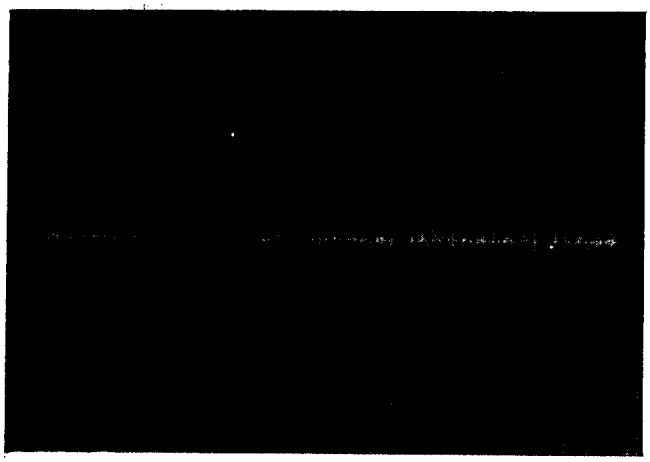
Figure 6:
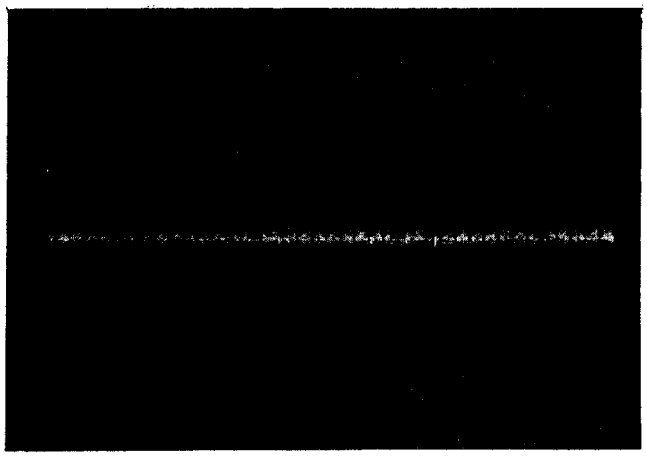

The melting method of these test pieces is as follows. Electrolytical iron, electrolytical chromium, electrolytical nickel, ferrosilicon, electrolytical manganese, high carbon ferrochromium, ferroniobium, tantalum, ferrozirconium and titanium are used as raw materials for melting. They are melted in a vacuum high-frequency induction furnace in the cases of Nos. 1–6 test pieces, and in an atmospheric high-frequency induction furnace in the cases of Nos. 7–21 test pieces, then cast in a 10 kg-capacity square mould. The 10 Kg-square ingots thus obtained are forged to (8×100×1mm) steel plates, and then cold-rolled to (2×100×1mm) steel plates, annealed and then pickled with acid. The surface appearance of these test pieces obtained from the steel plates 2 mm-thick thus obtained is investigated. The results are shown in Table 3 and typical examples are shown in FIGS. 3–6.

TABLE 3

Surface appearance of steel plate 2 mm-thick, and test results of Macro-Streak-Flow Test of steel plate 8 mm thick.

| | Test piece No. | Surface Appearance of Steel plate: Snow grade | Macro-Streak-Flaw Test I | II | III |
|---|---|---|---|---|---|
| Steel for comparison | 1 | Δ | A | A | A |
| | 2 | Δ | A | A | A |
| | 3 | Δ | A | A | A |
| | 4 | Δ | A | A | A |
| | 5 | x | B | A | B |
| | 6 | Δ | A | A | A |
| | 7 | Δ | B | B | A |
| | 8 | | D | C | B |
| | 9 | | D | D | C |
| | 10 | | D | C | C |
| | 11 | | D | B | C |
| | 12 | x | C | D | B |
| | 13 | | D | C | C |
| Steel of the invention | 14 | o | A | A | A |
| | 15 | o | A | A | A |
| | 16 | o | A | A | A |

TABLE 3-continued

Surface appearance of steel plate 2 mm-thick, and test results of Macro-Streak-Flow Test of steel plate 8 mm thick.

| | Test piece No. | Surface Appearance of Steel plate: Snow grade | Macro-Streak-Flaw Test I | II | III |
|---|---|---|---|---|---|
| vention | 17 | o | A | A | A |
| | 18 | o | A | A | A |
| | 19 | o | A | A | A |
| Steel for comparison | 20 | Δ | C | B | A |
| | 21 | Δ | B | A | B |

(Remarks)
Snow grade
o: few snows are observed
Δ: only a few snows are observed
x: some snows are observed
: remarkable number of snows are observed.
Test standard of Macro-Streak-Flaw Test
A: No number restriction to base defects having length of 0.8 mm or less, 2 or less of base defects having length from more than 0.8 to 1.0 mm or less.
B: 30 or less of base defects having length from more than 1.0 to 1.5 mm or less, 2 or less of base defects having length from more than 1.5 to 2.0 mm or less.
C: No number restriction to base defects having length from more than 2.0 to 4.0 mm or less, 1 or less of base defect having length from more than 4.0 to 5.0 mm or less.
D: Presence of base defects having length more than 5.0 mm.

As is obvious from Table 3, the surface appearance of steel test pieces Nos. 14–19 of the present invention, which have been made by the addition of titanium, in a given amount are superior to those of the steel for comparison. There are few clusters lying under the surface, contents of which are tested by the Macro-Streak-Flaw test method,*) in the case of steel of the present invention. [Remark *): Macro-Streak-Flaw test method is a method to count the number of defects lying on or under the surface of steel plate. Thus, the surface layer of the steel plate is shaved off to a certain depth three times, and then the appearance of each shaved surface is investigated to find if there are surface defects or not.]

Test pieces Nos. 16 and 19, which are obtained by the process comprising the step of oxygen removal by Al or Ca before the addition of titanium, are good in snow grade as shown in Table 3. Therefore, the present invention is not deteriorated even if Al or Ca is admixed in an amount of 0.1% or less before the addition of titanium.

Results of anti-corrosive ability tests of solution-treated steel (under 1,130° C.×18 minutes and air cooling) and sensitized steel (under 650° C.×2 hours and air cooling) in a liquid or vapour phase of 98% concentrated nitric acid at the boiling temperature under the atmosphere are shown in Table 4. The anti-corrosive ability of the steel of the present invention against the high concentrated nitric acid is not deteriorated by the addition of titanium.

TABLE 4

The results of anti-corrosive ability ($g/m^2$ Hr, average of 5 tests) Condition in 98% nitric acid under boiling for 24 hours.

| | Test piece No. | Solution-treated steel | | Sensitized steel | |
|---|---|---|---|---|---|
| | | liquid phase | vapour phase | liquid phase | vapour phase |
| Steel for comparison | 8 | 0.06 | 0.18 | 0.044 | 0.186 |
| | 13 | 0.02 | 0.01 | 0.015 | 0.009 |
| Steel of the invention | 16 | 0.05 | 0.16 | 0.040 | 0.173 |
| | 18 | 0.02 | 0.01 | 0.013 | 0.011 |

What is claimed is:

1. A method for reducing surface defects of specific steel resistant to concentrated nitric acid, wherein the specific steel is either stainless steel comprising carbon in an amount of not more than 0.1% ($C \leqq 0.1\%$), silicon in an amount from not less than 2.5% to not more than 5.0% ($2.5 \leqq Si \leqq 5\%$), manganese in an amount of not more than 2% ($Mn \leqq 2\%$), chromium in an amount from not less than 15% to not more than 20% ($15 \leqq Cr \leqq 20\%$), nickel in an amount from not less than 10% to not more than 22% ($10 \leqq Ni \leqq 22\%$), at least one of niobium, tantalum and zirconium in an amount from not less than 10 times the carbon content to not more than 2.5% ($C \times 10 \leqq Nb$, Ta and/or $Zr \leqq 2.5\%$), and the balance being iron and inevitable impurities, or a high-silicon-nickel-chromium steel comprising:

carbon in an amount of not more than 0.03% ($C \leqq 0.03\%$), silicon in an amount from more than 5% to not more than 7% ($5 \leqq Si \leqq 7\%$), manganese in an amount of not more than 10% ($Mn \leqq 10\%$), chromium in an amount from not less than 7% to not more than 16%, nickel in an amount from not less than 10% to less than 19% ($10 \leqq Ni \leqq 19\%$), at least one of niobium, tantalum and zirconium in an amount from not less than 4 times the carbon content to not more than 2%, and the balance being iron and inevitable impurities, characterized by adding titanium in an amount from not less than 0.05% to not more than 0.2% ($0.05 \leqq Ti \leqq 0.2\%$) to melted steel and thereafter removing titanium slag when producing said steel, percentages being by weight.

2. The method according to claim 1, wherein the steps of addition of titanium to said melted steel and removal of titanium slag are performed before the addition of said at least one of niobium, tantalum and zirconium to the melted steel when producing the steel.

3. The method according to claim 2, wherein said titanium slag is removed from the melted steel by floatation separation.

4. The method according to claim 2, wherein oxygen is removed from the melted steel by aluminum or calcium before the said addition of titanium.

* * * * *